US007721805B2

(12) United States Patent
Hill et al.

(10) Patent No.: US 7,721,805 B2
(45) Date of Patent: May 25, 2010

(54) METHOD AND APPARATUS TO HYDRAULICALLY BYPASS A WELL TOOL

(75) Inventors: Thomas G. Hill, The Woodlands, TX (US); Jeffrey L. Bolding, Kilgore, TX (US); David Randolph Smith, Kilgore, TX (US)

(73) Assignee: BJ Services Company, U.S.A., Houston, TX (US)

( * ) Notice: Subject to any disclaimer, the term of this patent is extended or adjusted under 35 U.S.C. 154(b) by 0 days.

(21) Appl. No.: 12/158,659

(22) PCT Filed: Jul. 10, 2006

(86) PCT No.: PCT/US2006/026782

§ 371 (c)(1),
(2), (4) Date: Jun. 20, 2008

(87) PCT Pub. No.: WO2007/073401

PCT Pub. Date: Jun. 28, 2007

(65) Prior Publication Data

US 2008/0277119 A1 Nov. 13, 2008

Related U.S. Application Data

(63) Continuation-in-part of application No. PCT/US2005/047007, filed on Dec. 22, 2005.

(60) Provisional application No. 60/593,217, filed on Dec. 22, 2004.

(51) Int. Cl.
*E21B 43/16* (2006.01)
*E21B 23/01* (2006.01)

(52) U.S. Cl. ..... 166/305.1; 166/90.1; 166/129; 166/169; 166/183

(58) Field of Classification Search ..... None
See application file for complete search history.

(56) References Cited

U.S. PATENT DOCUMENTS 6,776,239 B2 8/2004 Eslinger et al. ..... 166/308.1

OTHER PUBLICATIONS

PCT International Search Report and Written Opinion corresponding to PCT/US2006/026782, dated Dec. 26, 2006.

*Primary Examiner*—Zakiya W. Bates
(74) *Attorney, Agent, or Firm*—Zarian Midgley & Johnson PLLC

(57) ABSTRACT

Apparatuses and methods to communicate with a zone below a subsurface safety valve (104, 204, 404) independent of the position of a closure member (106) of the safety valve. The apparatuses and methods include deploying a subsurface safety valve (104, 204, 404) to a profile located within a string of production tubing. The subsurface safety valve (104, 204, 404) is in communication with a surface station through an injection conduit (150,152; 250,252; 450; 452) and includes a bypass pathway (144, 244, 444) to inject various fluids to a zone below. A redundant control to actuate subsurface safety valve (104, 204, 404) can include a three-way valve (180, 280) or three-way manifold 480 connecting the injection conduit (150,152; 250,252; 452) or the hydraulic ports (140, 142; 240,242; 442') to the subsurface safety valve (104, 204, 404).

25 Claims, 5 Drawing Sheets

METHOD AND APPARATUS TO HYDRAULICALLY BYPASS A WELL TOOL

CROSS-REFERENCE TO RELATED APPLICATION

This application is a continuation-in-part of PCT Application Ser. No. US2005/047007 filed Dec. 22, 2005.

BACKGROUND OF THE INVENTION

The present invention generally relates to subsurface apparatuses used in the petroleum production industry. More particularly, the present invention relates to an apparatus and method to conduct fluid through subsurface apparatuses, such as a subsurface safety valve, to a downhole location. More particularly still, the present invention relates to apparatuses and methods to install a subsurface safety valve incorporating a bypass conduit allowing communications between a surface station and a lower zone regardless of the operation of the safety valve.

Various obstructions exist within strings of production tubing in subterranean wellbores. Valves, whipstocks, packers, plugs, sliding side doors, flow control devices, expansion joints, on/off attachments, landing nipples, dual completion components, and other tubing retrievable completion equipment can obstruct the deployment of capillary tubing strings to subterranean production zones. One or more of these types of obstructions or tools are shown in the following United States patents which are incorporated herein by reference: Young, U.S. Pat. No. 3,814,181; Pringle, U.S. Pat. No. 4,520,870; Carmody et al., U.S. Pat. No. 4,415,036; Pringle, U.S. Pat. No. 4,460,046; Mott, U.S. Pat. No. 3,763,933; Morris, U.S. Pat. No. 4,605,070; and Jackson et al., U.S. Pat. No. 4,144,937. Particularly, in circumstances where stimulation operations are to be performed on non-producing hydrocarbon wells, the obstructions stand in the way of operations that are capable of obtaining continued production out of a well long considered depleted. Most depleted wells are not lacking in hydrocarbon reserves, rather the natural pressure of the hydrocarbon producing zone is so low that it fails to overcome the hydrostatic pressure or head of the production column. Often, secondary recovery and artificial lift operations will be performed to retrieve the remaining resources, but such operations are often too complex and costly to be performed on all wells. Fortunately, many new systems enable continued hydrocarbon production without costly secondary recovery and artificial lift mechanisms. Many of these systems utilize the periodic injection of various chemical substances into the production zone to stimulate the production zone thereby increasing the production of marketable quantities of oil and gas. However, obstructions in the producing wells often stand in the way of deploying an injection conduit to the production zone so that the stimulation chemicals can be injected. While many of these obstructions are removable, they are typically components required to maintain production of the well so permanent removal is not feasible. Therefore, a mechanism to work around them would be highly desirable.

The most common of these obstructions found in production tubing strings are subsurface safety valves. Subsurface safety valves are typically installed in strings of tubing deployed to subterranean wellbores to prevent the escape of fluids from the wellbore to the surface. Absent safety valves, sudden increases in downhole pressure can lead to disastrous blowouts of fluids into the atmosphere. Therefore, numerous drilling and production regulations throughout the world require safety valves be in place within strings of production tubing before certain operations are allowed to proceed.

Safety valves allow communication between the isolated zones and the surface under regular conditions but are designed to shut when undesirable conditions exist. One popular type of safety valve is commonly referred to as a surface controlled subsurface safety valve (SCSSV). SCSSVs typically include a closure member generally in the form of a circular or curved disc, a rotatable ball, or a poppet, that engages a corresponding valve seat to isolate zones located above and below the closure member in the subsurface well. The closure member is preferably constructed such that the flow through the valve seat is as unrestricted as possible. Usually, the SCSSVs are located within the production tubing and isolate production zones from upper portions of the production tubing. Optimally, SCSSVs function as high-clearance check valves, in that they allow substantially unrestricted flow therethrough when opened and completely seal off flow in one direction when closed. Particularly, production tubing safety valves prevent fluids from production zones from flowing up the production tubing when closed but still allow for the flow of fluids (and movement of tools) into the production zone from above.

SCSSVs normally have a hydraulic control line extending from the valve, said hydraulic control line disposed in an annulus formed by the well casing and the production tubing and extending from the surface. Pressure in the hydraulic control line opens the valve allowing production or tool entry through the valve. Any loss of pressure in the hydraulic control line closes the valve, prohibiting flow from the subterranean formation to the surface.

Closure members are often energized with a biasing member (spring, hydraulic cylinder, gas charge and the like, as well known in the industry) such that in a condition with no pressure, the valve remains closed. In this closed position, any build-up of pressure from the production zone below will thrust the closure member against the valve seat and act to strengthen any seal therebetween. During use, closure members are opened to allow the free flow and travel of production fluids and tools therethrough.

Formerly, to install a chemical injection conduit around a production tubing obstruction, the entire string of production tubing had to be retrieved from the well and the injection conduit incorporated into the string prior to replacement often costing millions of dollars. This process is not only expensive but also time consuming, thus it can only be performed on wells having enough production capability to justify the expense. A simpler and less costly solution would be well received within the petroleum production industry and enable wells that have been abandoned for economic reasons to continue to operate.

SUMMARY OF THE INVENTION

The deficiencies of the prior art are addressed by an assembly to inject fluid around a well tool located within a string of production tubing.

In one embodiment, an assembly to inject fluid from a surface station around a well tool located within a string of production tubing, the assembly comprises a lower anchor socket located in the string of production tubing below the well tool, an upper anchor socket located in the string of production tubing above the well tool, a lower injection anchor seal assembly engaged within the lower anchor socket, an upper injection anchor seal assembly engaged within the upper anchor socket, a first injection conduit extending from the surface station to the upper injection anchor seal assembly, the first injection conduit in communication with a first hydraulic port of the upper anchor socket, a second injection conduit extending from the lower injection anchor seal assembly to a location below the well tool, the second injection conduit in communication with a second hydraulic port of the lower anchor socket, and a fluid pathway to bypass the well tool and allow hydraulic communication between the first hydraulic port and the second hydraulic port. The well tool can be a subsurface safety valve. The well tool can be selected from the group consisting of whipstocks, packers, bore plugs, and dual completion components.

In another embodiment, the lower anchor socket, the well tool, and the upper anchor socket can be a single tubular sub in the string of production tubing.

In yet another embodiment, the lower anchor socket, the well tool, and the upper anchor socket can each be a separate tubular sub in the string of production tubing, the lower anchor socket tubular sub threadably engaged to the well tool tubular sub and the well tool tubular sub threadably engaged to the upper anchor socket tubular sub.

In another embodiment, an assembly to inject fluid from a surface station around a well tool located within a string of production tubing comprises an operating conduit extending from the subsurface safety valve to the surface station through an annulus formed between the string of production tubing and a wellbore. The assembly can further comprise an alternative injection conduit extending from the surface station to the second hydraulic port. The assembly can further comprise an alternative injection conduit extending from the surface station to the first hydraulic port. The first or second injection conduit can include a check valve. The fluid pathway can be internal to the assembly. The fluid pathway can be a tubular conduit external to the assembly.

The assembly to inject fluid around a well tool located within a string of production tubing can further comprise at least one shear plug to block the first hydraulic port and the second hydraulic port from communication with a bore of the string of production tubing when the injection anchor seal assemblies are not engaged therein.

In yet another embodiment, an assembly to inject fluid around a well tool located within a string of production tubing comprises a lower anchor socket located in the string of production tubing below the well tool and an upper anchor socket located in the string of production tubing above the well tool, a lower injection anchor seal assembly engaged within the lower anchor socket and an upper injection anchor seal assembly engaged within the upper anchor socket, a lower injection conduit extending from the lower injection anchor seal assembly to a location below the well tool, the lower injection conduit in hydraulic communication with a hydraulic port of the lower anchor socket, an upper injection conduit extending from a surface station to the upper injection anchor seal assembly, the upper injection conduit in hydraulic communication with a hydraulic port of the upper anchor socket, and a fluid pathway extending between the upper and lower anchor sockets through an annulus between the string of production tubing and a wellbore, the fluid pathway in hydraulic communication with the upper and lower hydraulic ports. The well tool can be a subsurface safety valve. The well tool can be selected from the group consisting of whipstocks, packers, bore plugs, and dual completion components. The assembly can further comprise a check valve in at least one of the upper and lower injection conduits.

In another embodiment, an assembly to inject fluid around a well tool located within a string of production tubing comprises an anchor socket located in the string of production tubing below the well tool, an injection anchor seal assembly engaged within the anchor socket, an injection conduit extending from the injection anchor seal assembly to a location below the well tool, the injection conduit in hydraulic communication with a hydraulic port of the anchor socket, and a fluid pathway extending from a surface station through an annulus between the string of production tubing and a wellbore, the fluid pathway in hydraulic communication with the hydraulic port.

In yet another embodiment, an assembly to inject fluid around a well tool located within a string of production tubing further comprises an upper anchor socket located in the string of production tubing above the well tool, an upper injection anchor seal assembly engaged within the upper anchor socket, an upper injection conduit extending from the surface station to the upper injection anchor seal, the upper injection conduit in hydraulic communication with an upper hydraulic port of the upper anchor socket, and a second fluid pathway hydraulically connecting the upper hydraulic port with the hydraulic port of the anchor socket below the well tool.

In another embodiment, an assembly to inject fluid around a well tool located within a string of production tubing can include a hydraulic control line in communication with a surface location and the well tool, said hydraulic control line in further communication with at least one of the first hydraulic port of said upper anchor socket, the second hydraulic port of said lower anchor socket, and the fluid pathway. A hydraulic control line can include a three-way valve, the valve having a first position wherein the surface location and the well tool are in communication and communication with said at least one of the first hydraulic port of said upper anchor socket, the second hydraulic port of said lower anchor socket, and the fluid pathway is inhibited, and a second position wherein said at least one of the first hydraulic port of said upper anchor socket, the second hydraulic port of said lower anchor socket, and the fluid pathway is in communication with the well tool and communication with the surface location is inhibited. A hydraulic control line can include a burst disc between the three-way valve and said at least one of the first hydraulic port of said upper anchor socket, the second hydraulic port of said lower anchor socket, and the fluid pathway.

In yet another embodiment, a hydraulic control line can extend through an annulus formed between the string of production tubing and a wellbore. A fluid pathway can extend between the upper and lower anchor sockets through an annulus formed between the string of production tubing and a wellbore.

In another embodiment, an assembly to inject fluid around a well tool located within a string of production tubing can include an anchor socket located in the string of production tubing below the well tool, an injection anchor seal assembly engaged within said anchor socket, an injection conduit extending from said injection anchor seal assembly to a location below the well tool, said injection conduit in hydraulic communication with a hydraulic port of said anchor socket, a fluid pathway extending from a surface station through an annulus between the string of production tubing and a wellbore, the fluid pathway in communication with said hydraulic port, and a hydraulic control line in communication with a surface location and the well tool, said hydraulic control line in further communication with at least one of the hydraulic port of said anchor socket, the injection conduit, and the fluid pathway. The well tool can be a subsurface safety valve. The hydraulic control line can include a three-way valve, the valve having a first position wherein the surface location and the well tool are in communication and communication with said at least one of the hydraulic port of said anchor socket, the injection conduit, and the fluid pathway is inhibited, and a second position wherein said at least one of the hydraulic port of said anchor socket, the injection conduit, and the fluid pathway is in communication with the well tool and communication with the surface location is inhibited. A three-way valve can actuate from the first position to the second position when a fluid is injected at an opening pressure through said at least one of the hydraulic port of said anchor socket, the injection conduit, and the fluid pathway. A hydraulic control line can include a burst disc between the three-way valve and said at least one of the hydraulic port of said anchor socket, the injection conduit, and the fluid pathway.

In yet another embodiment, an assembly to inject fluid from a surface station around a well tool located within a string of production tubing can include a lower anchor socket located in the string of production tubing below the well tool, an upper anchor socket located in the string of production tubing above the well tool, a lower injection anchor seal assembly engaged within said lower anchor socket, an upper injection anchor seal assembly engaged within said upper anchor socket, a first injection conduit extending from the surface station to said upper injection anchor seal assembly, said first injection conduit in communication with a first hydraulic port of said upper anchor socket, a second injection conduit extending from said lower injection anchor seal assembly to a location below the well tool, said second injection conduit in communication with a second hydraulic port of said lower anchor socket, a fluid pathway to bypass the well tool and allow hydraulic communication between said first hydraulic port and said second hydraulic port, and a hydraulic control line extending between the well tool and at least one of the first hydraulic port of said upper anchor socket, the second hydraulic port of said lower anchor socket, and the fluid pathway. A burst disc can be disposed in the hydraulic control line.

In another embodiment, a method to inject fluid around a well tool located within a string of production tubing comprises installing the string of production tubing into a wellbore, the string of production tubing including a lower anchor socket below the well tool and an upper anchor socket above the well tool, installing a lower anchor seal assembly to the lower anchor socket, the lower anchor seal assembly including a lower injection conduit extending therebelow, installing an upper anchor seal assembly to the upper anchor socket, the upper anchor seal assembly disposed upon a distal end of an upper injection conduit extending from a surface station, and communicating between the upper injection conduit and the lower injection conduit through a fluid pathway around the well tool. The well tool can be a subsurface safety valve.

In yet another embodiment, a method to inject fluid around a well tool located within a string of production tubing further comprises installing an alternative injection conduit extending from the surface station to the lower anchor seal assembly.

In another embodiment, a method to inject fluid around a well tool located within a string of production tubing further comprises installing an alternative injection conduit extending from the surface station to the upper anchor seal assembly.

In another embodiment, a method to inject fluid around a well tool located within a string of production tubing further comprises restricting reverse fluid flow in the lower injection conduit with a check valve.

In yet another embodiment, a method to inject fluid around a well tool located within a string of production tubing comprises installing the string of production tubing into a wellbore, the string of production tubing including the well tool, an anchor socket above the well tool, and a lower string of injection conduit extending below the well tool, installing an anchor seal assembly to the anchor socket, the anchor seal assembly deposed upon a distal end of an upper string of injection conduit extending from a surface station, and communicating between the upper string of injection conduit and the lower string of injection conduit through a fluid pathway extending from the anchor seal assembly to the lower string of injection conduit around the well tool. The well tool can be selected from the group consisting of subsurface safety valves, whipstocks, packers, bore plugs, and dual completion components.

In another embodiment, a method to inject fluid around a well tool located within a string of production tubing comprises installing the string of production tubing into a wellbore, the string of production tubing including the well tool and an anchor socket below the well tool, installing an anchor seal assembly to the anchor socket, the anchor seal assembly including a lower injection conduit extending therebelow, deploying a fluid pathway from a surface location to the anchor socket through an annulus formed between the string of production tubing and the wellbore, and providing hydraulic communication between the surface location and the lower injection conduit through the fluid pathway.

In yet another embodiment, a method to inject fluid around a well tool located within a string of production tubing comprises providing an upper anchor socket in the string of production tubing above the well tool, installing an upper anchor seal assembly to the upper anchor socket, the upper anchor seal assembly disposed upon a distal end of an upper injection conduit extending from the surface location, and communicating between the upper injection conduit and the lower injection conduit through a second fluid pathway extending between the upper anchor seal assembly and the anchor seal assembly located in the anchor socket below the well tool.

In another embodiment, a method to inject fluid around a well tool located within a string of production tubing comprises installing the string of production tubing into a wellbore, the string of production tubing including a lower anchor socket below the well tool providing an inner chamber circumferentially spaced about a longitudinal axis of the lower anchor socket, an upper anchor socket above the well tool providing an inner chamber circumferentially spaced about a longitudinal axis of the upper anchor socket, and a fluid pathway on an exterior of the well tool hydraulically connecting the inner chambers of the upper and lower anchor sockets, establishing a fluid communication pathway between an inner surface of the upper and lower anchor sockets and the respective circumferentially spaced inner chambers, installing a lower anchor seal assembly to the lower anchor socket, the lower anchor seal assembly including a lower injection conduit extending therebelow, installing an upper anchor seal assembly in the upper anchor socket, the upper anchor seal assembly disposed upon a distal end of an upper injection conduit extending from a surface station, and communicating between the upper and lower injection conduits through the fluid communication pathway of the upper anchor socket, the fluid pathway, and the fluid communication pathway of the lower anchor socket.

In yet another embodiment, a method to inject fluid from a surface station around a subsurface safety valve located within a string of production tubing can include installing the string of production tubing into a wellbore, the string of production tubing including a lower anchor socket below the subsurface safety valve and an upper anchor socket above the subsurface safety valve, installing a lower anchor seal assembly to the lower anchor socket, the lower anchor seal assembly including a lower injection conduit extending therebelow, installing an upper anchor seal assembly to the upper anchor socket, the upper anchor seal assembly disposed upon a distal end of an upper injection conduit extending from a surface station, installing a hydraulic control line extending from a surface location to a three-way valve, the three-way valve connecting the hydraulic control line, a hydraulically actuated closure member of the subsurface safety valve, and the upper injection conduit, the valve having a first position wherein the hydraulic control line and the hydraulically actuated closure member are in communication and communication with the upper injection conduit is inhibited, and a second position wherein the upper injection conduit is in communication with the hydraulically actuated closure member and communication with the hydraulic control line is inhibited, and communicating between the upper injection conduit and the lower injection conduit through a fluid pathway around the subsurface safety valve. A method to inject fluid can include injecting a fluid from the surface station through the upper injection conduit, the fluid displacing the three-way valve to the second position, and actuating the hydraulically actuated closure member from the surface station through the upper injection conduit.

In another embodiment, a method to inject fluid from a surface station around a subsurface safety valve located within a string of production tubing can include installing an assembly to inject fluid from a surface station around a well tool located within a string of production tubing into a well bore, and injecting a fluid from the surface station through the first injection conduit, the fluid pathway, and the second injection conduit into the location below the well tool at a pressure lower than a rupture pressure of the burst disc. A method to inject fluid can include injecting the fluid through said at least one of the first hydraulic port of said upper anchor socket, the second hydraulic port of said lower anchor socket, and the fluid pathway at least at the rupture pressure to rupture the burst disc, disposing the three-way valve to the second position, and actuating a closure member of the subsurface safety valve through the first injection conduit. The step of injecting the fluid at least at the rupture pressure can dispose the three-way valve to the second position after the burst disc ruptures.

In yet another embodiment, an assembly to inject fluid from a surface station around a well tool located within a string of production tubing can include a lower anchor socket located in the string of production tubing below the well tool, an upper anchor socket located in the string of production tubing above the well tool, a lower injection anchor seal assembly engaged within said lower anchor socket, an upper injection anchor seal assembly engaged within said upper anchor socket, a first injection conduit extending from the surface station to said upper injection anchor seal assembly, said first injection conduit in communication with a first hydraulic port of said upper anchor socket, a second injection conduit extending from said lower injection anchor seal assembly to a location below the well tool, said second injection conduit in communication with a second hydraulic port of said lower anchor socket, a fluid pathway to bypass the well tool and allow hydraulic communication between said first hydraulic port and said second hydraulic port, a hydraulic control line in communication with a surface location and the well tool, said hydraulic control line in further communication with a redundant control hydraulic port of said upper anchor socket, and means for enabling communication between the redundant control hydraulic port and the first injection conduit. The means for enabling communication between the redundant control hydraulic port and the first injection conduit can include a downhole punch to create a fluid communication pathway in the upper anchor socket in communication with the redundant control hydraulic port and the first injection conduit. The hydraulic control line can include a three-way valve, the valve having a first position wherein the surface location and the well tool are in communication and communication with the redundant control hydraulic port is inhibited, and a second position wherein the redundant control hydraulic port is in communication with the well tool and communication with the surface location is inhibited.

In another embodiment, a method to inject fluid from a surface station around a subsurface safety valve located within a string of production tubing can include installing the string of production tubing into a wellbore, the string of production tubing including a lower anchor socket below the subsurface safety valve and an upper anchor socket above the subsurface safety valve, installing a lower anchor seal assembly to the lower anchor socket, the lower anchor seal assembly including a lower injection conduit extending therebelow, installing an upper anchor seal assembly to the upper anchor socket, the upper anchor seal assembly disposed upon a distal end of an upper injection conduit extending from a surface station, and installing a hydraulic control line extending from a surface location to a three-way manifold, the three-way manifold connecting the hydraulic control line, a hydraulically actuated closure member of the subsurface safety valve, and a redundant control hydraulic port of the upper anchor socket. The method can include communicating between the upper injection conduit and the lower injection conduit through a fluid pathway around the subsurface safety valve. The method can include forming a fluid communication pathway in the upper anchor socket with a downhole punch, the fluid communication pathway in communication with the redundant control hydraulic port, and communicating between the upper injection conduit and the hydraulically actuated closure member through the fluid communication pathway and the redundant control hydraulic port. The method can include uninstalling the upper anchor seal assembly before forming the fluid communication pathway with the downhole punch, and reinstalling the upper anchor seal assembly thereafter or installing the upper anchor seal assembly before forming the fluid communication pathway with the downhole punch. The method can include blocking communication of the hydraulic control line between the surface location and the three-way manifold.

DETAILED DESCRIPTION OF THE PREFERRED EMBODIMENTS

Figure 1:
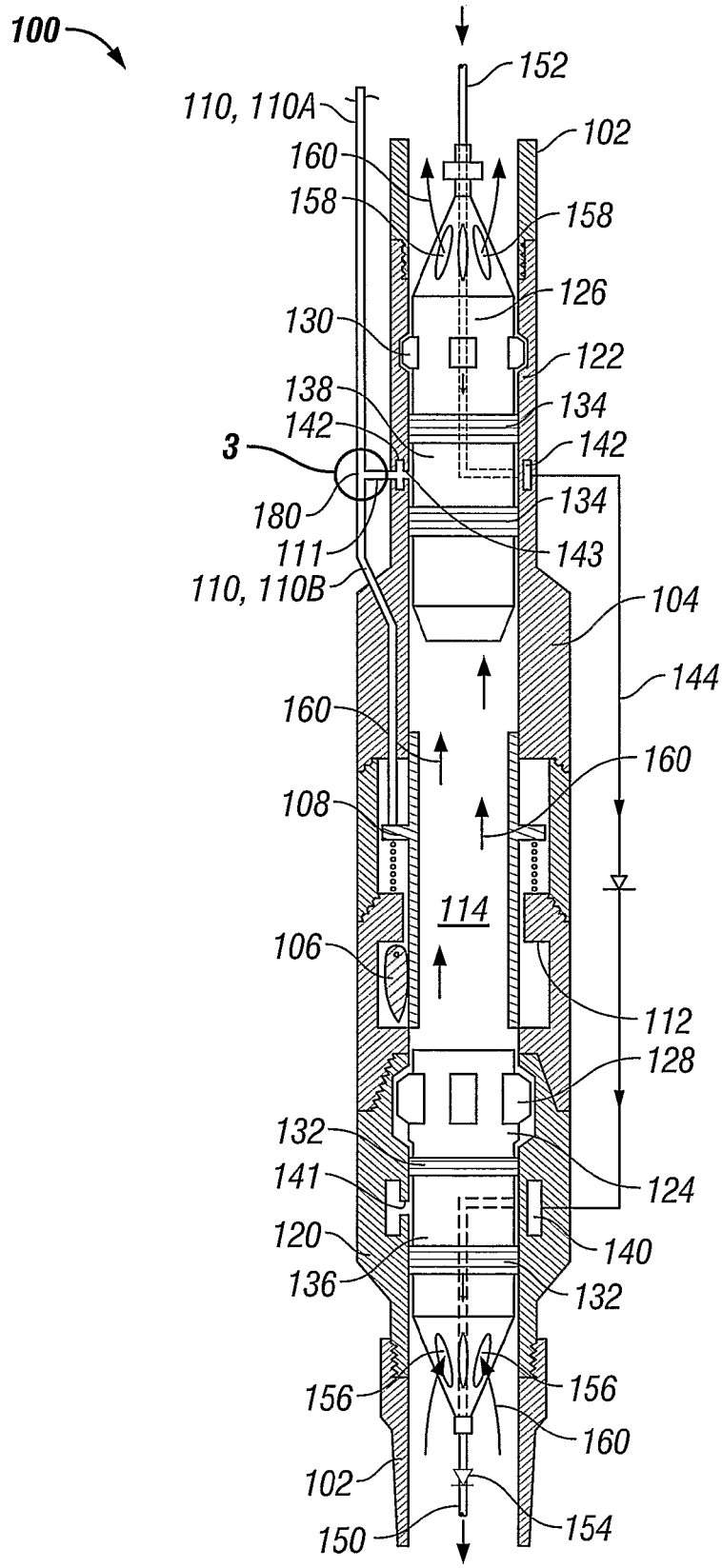
FIG. 1 is a schematic section-view drawing of a fluid bypass assembly in accordance with an embodiment of the present invention wherein the fluid bypass pathway is integral to the SCSSV assembly.

Referring initially to FIG. 1, a fluid bypass assembly 100 according to an embodiment of the present invention is shown. Fluid bypass assembly 100 is preferably run within a string of production tubing 102 and allows fluid to bypass a well tool 104. In FIG. 1, well tool 104 is shown as a subsurface safety valve but it should be understood by one skilled in the art that any well tool deployable upon a string of tubing can be similarly bypassed using the apparatuses and methods of the present invention. Nonetheless, well tool 104 of FIG. 1 is a subsurface safety valve run in-line with production tubing 102, and includes a flapper disc 106 closure member, an operating mandrel 108, and a hydraulic control line 110. Flapper disc 106 is preferably biased such that as operating mandrel 108 is retrieved from the bore of a valve seat 112, disc 106 closes and prevents fluids below safety valve 104 from communicating uphole. Hydraulic control line 110 operates operating mandrel 108 into and out of engagement with flapper disc 106, thereby allowing a user at the surface to manipulate the status of flapper disc 106.

Furthermore, fluid bypass assembly 100 includes a lower anchor socket 120 and an upper anchor socket 122, each configured to receive an anchor seal assembly 124, 126. Upper 126 and lower 124 anchor seal assemblies are configured to be engaged within anchor sockets 120, 122 and transmit injected fluids across well tool 104 with minimal obstruction of production fluids flowing through bore 114. Anchor seal assemblies 124, 126 include engagement members 128, 130 and packer seals 132, 134. Engagement members 128, 130 are configured to engage with and be retained by anchor sockets 120, 122, which may include an engagement profile. While one embodiment for engagement members 128, 130 and corresponding anchor sockets 120, 122 is shown schematically, it should be understood that numerous systems for engaging anchor seal assemblies 124, 126 into anchor sockets 120, 122 are possible without departing from the present invention.

Packer seals 132, 134 are located on either side of injection port zones 136, 138 of anchor seal assemblies 124, 126 and serve to isolate injection port zones 136, 138 from production fluids 160 traveling through bore 114 of well tool 104 and/or the bore of the string of production tubing 102. Furthermore, injection port zones 136, 138 are in communication with hydraulic ports 140, 142 in the circumferential wall of fluid bypass assembly 100 and hydraulic ports 140, 142 are in communication with each other through a hydraulic bypass pathway 144. Hydraulic ports 140, 142 can include a fluid communication pathway 141, 143 between an inner surface of the upper and lower anchor socket 120, 122 and a respective circumferentially spaced inner chamber in each anchor socket. Hydraulic ports 140, 142 may include a plurality of fluid communication pathways 141, 143. A hydraulic port 140, 142 may also communicate directly with the hydraulic bypass pathway 144 without the shown circumferentially spaced inner chamber.

Hydraulic bypass pathway 144 is shown schematically on FIG. 1 as an exterior line connecting hydraulic ports 140 and 142, but it should be understood that hydraulic bypass pathway 144 can be either a pathway inside (not shown) the body of bypass assembly 100 or an external conduit. Regardless of internal or external construction, hydraulic bypass pathway 144, hydraulic ports 140, 142, and packer seals 132, 134 enable injection port zone 138 to hydraulically communicate with injection port zone 136 without contamination from production fluids 160 flowing through bore 114 of well tool 104 and/or the bore of the string of production tubing 102. Additionally, it should be understood by one of ordinary skill in the art that it may be desired to use the production tubing 102 and well tool 104 of assembly 100 before anchor seal assemblies 124, 126 are installed into sockets 120, 122. As such, any premature hydraulic communication around well tool 104 between hydraulic ports 140 and 142 through hydraulic bypass pathway 144 could compromise the functionality of well tool 104 and such communication would need to be prevented. Therefore, shear plugs (not shown) can be located in hydraulic ports 140, 142 prior to deployment of well tool 104 upon production tubing 102 to prevent hydraulic bypass pathway 144 from allowing communication before it is desired. The shear plugs could be constructed to shear away and expose hydraulic ports 140 and 142 when anchor seal assemblies 124, 126, or another device, are engaged thereby.

A lower string of injection conduit 150 is suspended from lower anchor seal assembly 124 and upper anchor seal assembly 126 is connected to an upper string of injection conduit 152. Because lower injection conduit 150 is in communication with injection port zone 136 of lower anchor seal assembly 124 and upper injection conduit 152 is in communication with injection port zone 138 of upper anchor seal assembly 126, fluids flow from upper injection conduit 152, through hydraulic bypass pathway 144 to lower injection conduit 150. This communication may occur through an internal bypass pathway, shown as a dotted conduit in FIG. 1, in either or both of the upper or lower anchor seal assemblies 126, 124. As such, by using fluid bypass assembly 100, an operator can inject fluids below a well tool 104 regardless of the state or condition of well tool 104. Using fluid bypass assembly 100, fluids can be injected (or retrieved) past well tools 104 that would otherwise prohibit such communication. For example, where well tool 104 is a subsurface safety valve, the injection can occur when the flapper disc 106 is closed.

To install bypass assembly 100 of FIG. 1, the well tool 104, lower anchor socket 120 and upper anchor socket 122 are deployed downhole in-line with the string of production tubing 102. Once installed, well tool 104 can function as designed until injection below well tool 104 is desired. Once desired, lower anchor seal assembly 124 is lowered down production tubing 102 bore until it reaches well tool 104. Preferably, lower anchor seal assembly 124 is constructed such that it is able to pass through upper anchor socket 122 and bore 114 of well tool 104 without obstruction en route to lower anchor socket 120. Once lower anchor seal assembly 124 reaches lower anchor socket 120, it is engaged therein such that packer seals 132 properly isolate injection port zone 136 in contact with hydraulic port 140.

With lower anchor seal assembly 124 installed, upper anchor seal assembly 126 is lowered down production tubing 102 upon a distal end of upper injection conduit 152. Because upper anchor seal assembly 126 does not need to pass through bore 114 of well tool 104, it can be of larger geometry and configuration than lower anchor seal assembly 124. With upper anchor seal assembly 126 engaged within upper anchor socket 122, packer seals 134 isolate injection port zone 138 in contact with hydraulic port 142. Once installed, communication can occur between upper injection conduit 152 and lower injection conduit 150 through hydraulic ports 142, 140, injection port zones 138, 136, and hydraulic bypass pathway 144. Optionally, a check valve 154 can be located in lower injection conduit 150 to prevent production fluids 160 from flowing up to the surface through upper injection conduit 152. A check valve may be located in any section of the upper 152 or lower 150 injection conduits as well as the hydraulic bypass pathway 144. A check valve can be integrated into the upper or lower anchor seal assemblies 126, 124.

Ports 156, 158 in lower and upper anchor seal assemblies 124, 126 allow the flow of production fluids 160 to pass through with minimal obstruction. Furthermore, in circumstances where well tool 104 is to be a device that would not allow lower anchor seal assembly 124 to pass through a bore 114 of a well tool 104, the lower anchor seal assembly 124 can be installed before the production tubing 102 is installed into the well, leaving only upper anchor seal assembly 126 to be installed after production tubing 102 is disposed in the well.

Hydraulic control line 110 of bypass assembly 100 of FIG. 1 actuates operating mandrel 108 into and out of engagement with flapper disc 106, thereby allowing a user at the surface to manipulate the status of flapper disc 106 (e.g., closure member). However, as hydraulic control line 110 can become inoperable, for example, the inability to convey pressure from a loss of integrity, it can be desirable to provide a redundant control to regain surface control of the subsurface safety valve 104. One example of a redundant control is shown in FIG. 1. Hydraulic control line 110 typically extends from a surface location, which can be different from the surface station that upper injection conduit 152 extends from, to the subsurface safety valve 104, to allow communication therebetween to actuate the operating mandrel 108. To allow redundancy, the hydraulic control line 110 can be in further communication with any portion of the injection conduit (150, 152), and/or fluid or hydraulic bypass pathway 144 to allow injection conduit (150, 152) to actuate operating mandrel 108. In a preferred embodiment, the hydraulic control line 110, having a connection to the subsurface safety valve 104, is in further communication with at least one of the first hydraulic port 142 of upper anchor socket 122, the second hydraulic port 140 of lower anchor socket 120, and the fluid pathway 144 to enable redundancy. In the embodiment shown, the hydraulic control line 110 extends from a surface location, is in communication with the subsurface safety valve 104, and is in further communication with the first hydraulic port 142 of upper anchor socket 122. Such an arrangement allows a fluid injected through the upper injection conduit 152, and thus the fluidicly connected first hydraulic port 142 of upper anchor socket 122, to not only flow into the fluid pathway 144 to a location below the subsurface safety valve 104 for well injection, but also to flow into the hydraulic control line 110 for well tool 104 actuation. If so configured, the subsurface safety valve 104 can be actuated by injecting a fluid through either of the hydraulic control line 110 or the upper injection conduit 152.

Figure 3A:
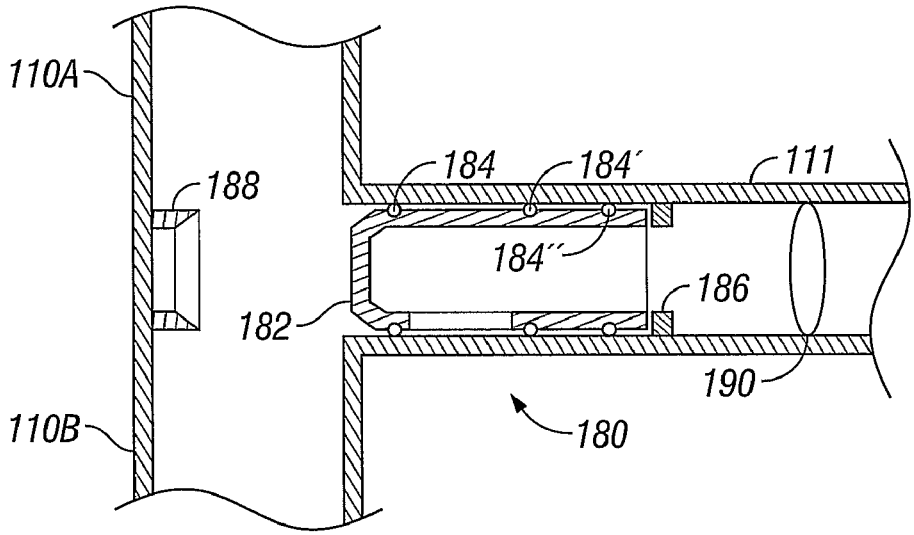
FIG. 3A is a schematic section-view drawing of a three-way valve in a first position, according to one embodiment of the invention.
Figure 3B:
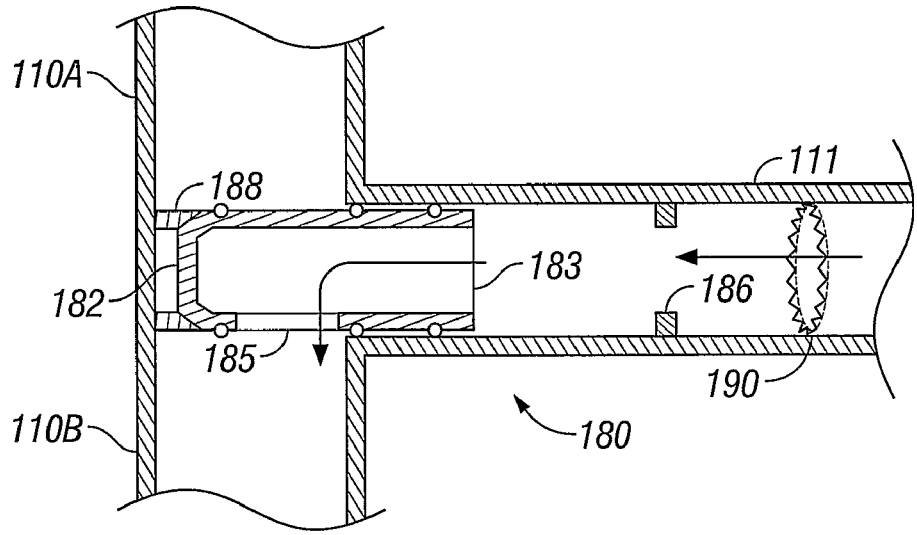
FIG. 3B is a schematic section-view drawing of a three-way valve in a second position, according to one embodiment of the invention.

In a preferred embodiment a three-way valve 180 is included to allow redundant control actuation of subsurface safety valve 104 even if hydraulic control line 110 has lost its ability to convey pressure, for example, a failure of hydraulic control line 110 between the three-way valve 180 and the surface location. The three-way valve 180, contained in the circle identified by reference character 3 in FIG. 1, is shown more clearly in FIGS. 3A and 3B. FIG. 3A is a schematic section-view of a three-way valve 180 with a sliding sleeve 182 in a first, open, position. Although three-way valve 180 is referred to as a valve, it is not required to be a separate valve and a sliding sleeve 182 or other three-way fluid flow regulation device can be integral to the tubing or conduit used. Three-way valve 180 is not required to have a sliding sleeve 182 as shown and any appropriate mechanism can be utilized.

The upper section 110A of hydraulic control line 110 extends from a surface location to the three-way valve 180. One port of the three-way valve 180 connects to the hydraulic port of a well tool, which is illustrated as a subsurface safety valve 104. The second port of the three-way valve 180 connects to a redundancy section 111 of conduit for connection to the injection conduit (150, 152) or anything in fluidic communication with said injection conduit (150, 152). Redundancy section 111 of conduit is preferably connected to at least one of the first hydraulic port 142 of upper anchor socket 122, the second hydraulic port 140 of lower anchor socket 120, and the fluid pathway 144 to allow the removal of upper 126 and lower 124 anchor seal assemblies. The three-way valve 180 includes a sliding sleeve 182 with an entry port 183 and an exit port 185. In FIG. 3A; the sliding sleeve 182 of the three-way valve 180 is in a first position, typically referred to as a closed position. In the first position, any fluid injected from a surface location through upper section 110A of hydraulic control line 110 will flow into lower section 110B of hydraulic control line 110 and thus to subsurface safety valve 104 for actuation. The sliding sleeve 182 is in contact with stop 186, which can be any type known in the art, to retain sliding sleeve 182 from further displacement. Sliding sleeve 182 can be sealed within the three-way valve 180, for example, by circumferential O-rings (184, 184', 184"). Three-way valve 180 can be biased, for example, by spring, to the first or second position, if desired.

When the three-way valve 180 is in the first, closed, position in FIG. 3A, any pressure imparted to sections 110A and 110B of hydraulic control line is not conveyed into redundancy section 111, and thus is not conveyed to the at least one of the first hydraulic port 142 of upper anchor socket 122, the second hydraulic port 140 of lower anchor socket 120, and the fluid pathway 144 connected to the redundancy section 111 of the hydraulic control line. The three-way valve 180 in the first, closed, position allows the hydraulic control line (110A, 110B) to function in a typical manner without communicating with redundancy section 111 and thus without communicating with the injection conduit (150, 152) and/or the fluid pathway 144. A burst disc 190, shown schematically, can be disposed in redundancy section 111 to inhibit the flow of fluid into the three-way valve 180 until a desired pressure is imparted. So equipped, the fluid injection portion of the assembly 100 can be used without any fluid being injected into the three-way valve 180 from the hydraulic control line 110, or vice-versa. When so desired, for example, a failure of upper section 110A of hydraulic control line 110, the three-way valve 180 can be disposed to the second position (FIG. 3B) by manual or automatic means. Sliding sleeve 182 can be properly orientated within the three-way valve 180 by any means known the art, including, but not limited to, a guide groove (not shown) to orientate the ports (183, 185). Although illustrated as a three-way valve 180 with a sliding sleeve 182, any type of three-way valve can be used without departing from the spirit of the invention.

In a preferred embodiment, to actuate the three-way valve 180 from the first, closed, position (FIG. 3A) into the second, or open, position (FIG. 3B), the pressure in the redundancy section 111 is increased to the rupture pressure of the burst disc 190. The rupture pressure of the burst disc 190 is preferably such that burst disc 190 does not rupture under typical injection pressures. In the embodiment shown in FIG. 1, the redundancy section 111 is connected to first hydraulic port 142 of upper anchor socket 122, and thus the fluid can be injected from a surface station through upper injection conduit 152. After the burst disc 190 is ruptured, the pressure of the fluid injected into redundancy section 111 can dispose the sliding sleeve 182 into the second, or open, position in FIG. 3B. The fluid can then flow through the entry port 183, out the exit port 185 of sliding sleeve 182 (as schematically shown by flow arrows), into the lower hydraulic control line 110B, and to the subsurface safety valve 104. Three-way valve 180 can include a seat 188 to seal the sliding sleeve 182 within the three-way valve 180 to prevent any fluid in redundancy section 111 and lower hydraulic control line 110B from escaping into upper hydraulic control line 110A. As communication with upper hydraulic control line 110A is inhibited in the second position, any inability of the upper hydraulic control line 110A to retain pressure does not affect the actuation of the subsurface safety valve 104 by fluid supplied from the upper injection conduit 152. In the second position (FIG. 3B) instead of the upper hydraulic control line 110A being in communication with, and thus actuating, the subsurface safety valve 104, the upper injection conduit 152 is in communication with subsurface safety valve 104. With the sliding sleeve 182 in the second position, the upper injection conduit 152 can be used as a redundant control line from the surface station to allow subsurface safety valve 104 actuation.

Although upper injection conduit 152 remains in fluid communication with the lower injection conduit 150 when three-way valve 180 is disposed into the second, or open, position (FIG. 3B), in a preferred embodiment the assembly 100 is such that any loss of pressure caused by injection of fluid into the wellbore with the lower injection conduit 150 can be overcome by increasing the injection pressure in the upper injection conduit 152 at the surface station to allow actuation of the subsurface safety valve 104. In the embodiment illustrated in FIG. 1, the upper injection conduit 152 is the input providing fluid to two outputs (e.g., the lower injection conduit 150 and the redundancy section 111). Fluid can be supplied by upper injection conduit 152 at a pressure sufficient to actuate the subsurface safety valve 104, taking into account the pressure loss associated with the concurrent expulsion of fluid from lower injection conduit 150. If so desired, lower injection conduit 150 can include means to inhibit or restrict the flow of fluid when so desired, which can aid in the actuation of subsurface safety valve 104.

A second valve (not shown) that is disposed from a first, or closed, position to a second, or open, position when exposed to a desired opening pressure can be used instead of, or in addition to, rupture disc 190, without departing from the spirit of the invention. In a preferred embodiment, this second valve remains in the second, or open, position after being exposed to the desired opening pressure. This feature of the second valve can be included into three-way valve 190 or a second valve can be used in addition to the three-way valve 190.

Three-way valve 180, redundancy section 111 of conduit, and upper 110A and lower 110B sections of hydraulic control line are shown as external to the assembly 100, however any or all of the components can be disposed, entirely or in-part, within the walls of the assembly 100, for example, to reduce the likelihood of damage from contact with the wellbore, well fluids, or other obstructions during installation. Although illustrated in reference to a subsurface safety valve, the injection conduit can be configured to be a redundant control for any well tool.

A hydraulic control line (not shown) can alternatively extend directly from at least one of the first hydraulic port 142 of upper anchor socket 122, the second hydraulic port 140 of lower anchor socket 120, and the fluid pathway 144 to the well tool 104, and does not have to extend to the surface (e.g., removal of upper hydraulic control line 110A in FIG. 1). An optional burst disc can be disposed in the hydraulic control line (not shown) between the at least one of the first hydraulic port 142 of upper anchor socket 122, the second hydraulic port 140 of lower anchor socket 120, and the fluid pathway 144 and the subsurface safety valve 104. So configured, the injection conduit (152, 150) can be used to bypass the subsurface safety valve 104 to inject fluids into the well independent of the position of the closure member of said subsurface safety valve 104 and if needed, the pressure can be increased to rupture the burst disc and allow injection conduit (150, 152), or anything in communication with said any portion of injection conduit (152, 150), to communicate, and thus actuate, subsurface safety valve 104.

Figure 2:
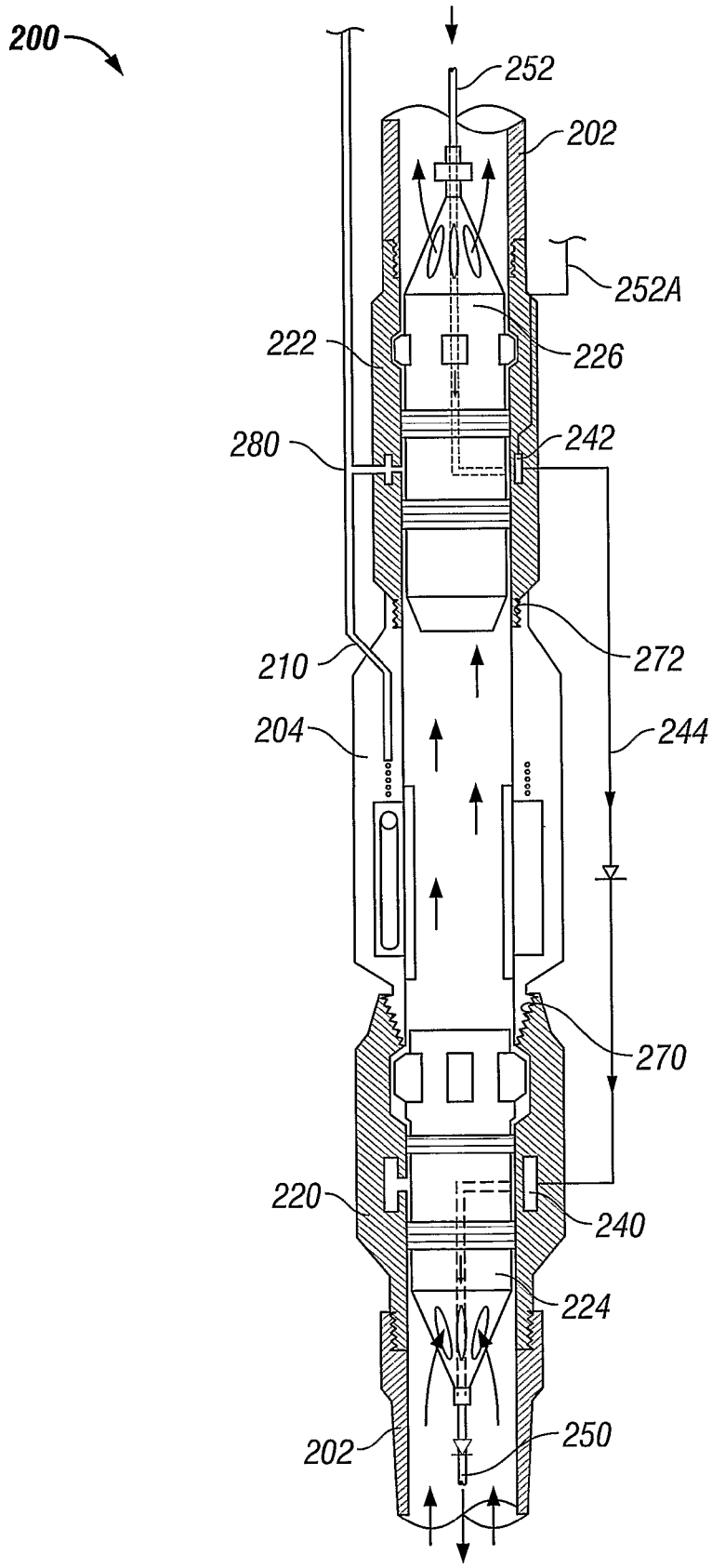
FIG. 2 is a schematic section-view drawing of a fluid bypass assembly in accordance with an alternative embodiment of the present invention wherein the fluid bypass pathway may be used with any industry standard SCSSV.

Referring briefly now to FIG. 2, an alternative embodiment for a fluid bypass assembly 200 is shown. Fluid bypass assembly 200 differs from fluid bypass assembly 100 of FIG. 1 in that assembly 200 is constructed from several threaded components rather than the unitary arrangement detailed in FIG. 1. Particularly, a string of production tubing 202 is connected to a well tool 204 through anchor socket subs 222, 220. Well tool 204, shown schematically as a surface controlled subsurface safety valve, is itself constructed as a sub with threaded connections 270, 272 on either end. Threaded connections 270, 272 allow for varied configurations of well tool 204 and anchor socket subs 220, 222 to be made. For instance, several well tools 204 can be strung together to form a combination of tools. Additionally, threaded connections 270, 272 allow more versatility and easier inventory management for remote locations, whereby an appropriate combination of anchor socket subs 220, 222 and well tools 204 can be made up for each particular well. Regardless of configuration of fluid bypass assembly 200, hydraulic bypass pathway 244 connects injection conduits 250 and 252 through hydraulic ports 240 and 242. Because of the modular arrangement of fluid bypass assembly 200, a hydraulic bypass pathway 244 is more likely to be an external conduit extending between anchor socket subs 220, 222, but with increased complexity, can still be constructed as an internal pathway, if so desired. The primary advantage derived from having hydraulic bypass pathway 244 as a pathway internal to fluid bypass assembly 200 is the reduced likelihood of damage from contact with the wellbore, well fluids, or other obstructions during installation. An internal hydraulic bypass pathway (not shown) would be shielded from such hazards by the bodies of anchor socket subs 220, 222 and well tool 204.

FIG. 2 further displays an alternative upper injection conduit 252A that may be deployed in the annulus between production tubing string 202 and the wellbore. Alternative upper injection conduit 252A would be installed in place of upper injection conduit 252 and would allow the injection of fluids into a zone below well tool 204 without the need for upper anchor seal assembly 226. Alternative upper injection conduit 252A would extend to hydraulic port 242 from the surface and communicate directly with hydraulic bypass pathway 244. Alternatively still, alternative upper injection conduit 252A could be installed in addition to upper injection conduit 252 to serve as a backup pathway to lower injection conduit 250 in the event of failure of upper injection conduit 252, hydraulic port 242, or upper anchor seal assembly 226. Furthermore, alternative upper injection conduit 252A can communicate directly with lower anchor seal assembly 224 through hydraulic port 240 if desired. A check valve may be located in any section of the upper 252 or lower 250 injection conduits as well as the hydraulic bypass pathway 244. A check valve can be integrated into the upper or lower anchor socket subs 222, 220.

The injection conduit (250, 252, and/or 252A) can optionally be used as a redundant control for a well tool, shown as a subsurface safety valve 204, in the manner discussed above.

Redundant control means illustrated in FIG. 2 includes a three-way valve 280, which can be a three-way manifold, connecting hydraulic control line 210 to first hydraulic port 242 of upper anchor socket 222. So configured, upper injection conduit 252, or alternative upper injection conduit 252A, can be used to actuate subsurface safety valve 204. Although not shown, if alternative upper injection conduit 252A is connected directly to lower hydraulic port 240, a redundancy section of hydraulic control line, which can include a three-way valve 280, can connect lower hydraulic port 240 to subsurface safety valve 204 to allow actuation of subsurface safety valve 204 through alternative upper injection conduit 252A independent of the presence of upper anchor seal assembly 226.

Figure 4A:
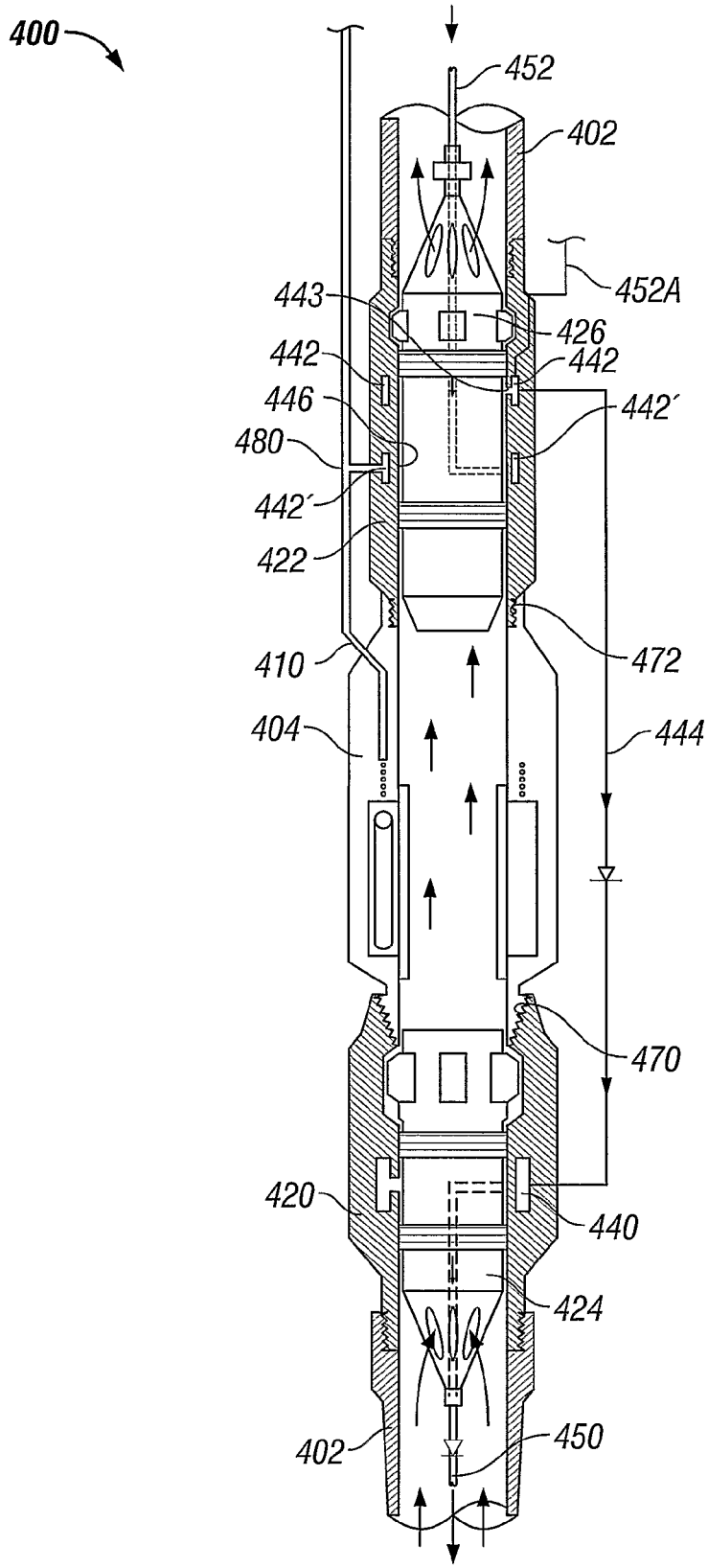
FIG. 4A is a schematic section-view drawing of a fluid bypass assembly in accordance with an alternative embodiment of the present invention before redundant control of the well tool is enabled.
Figure 4B:
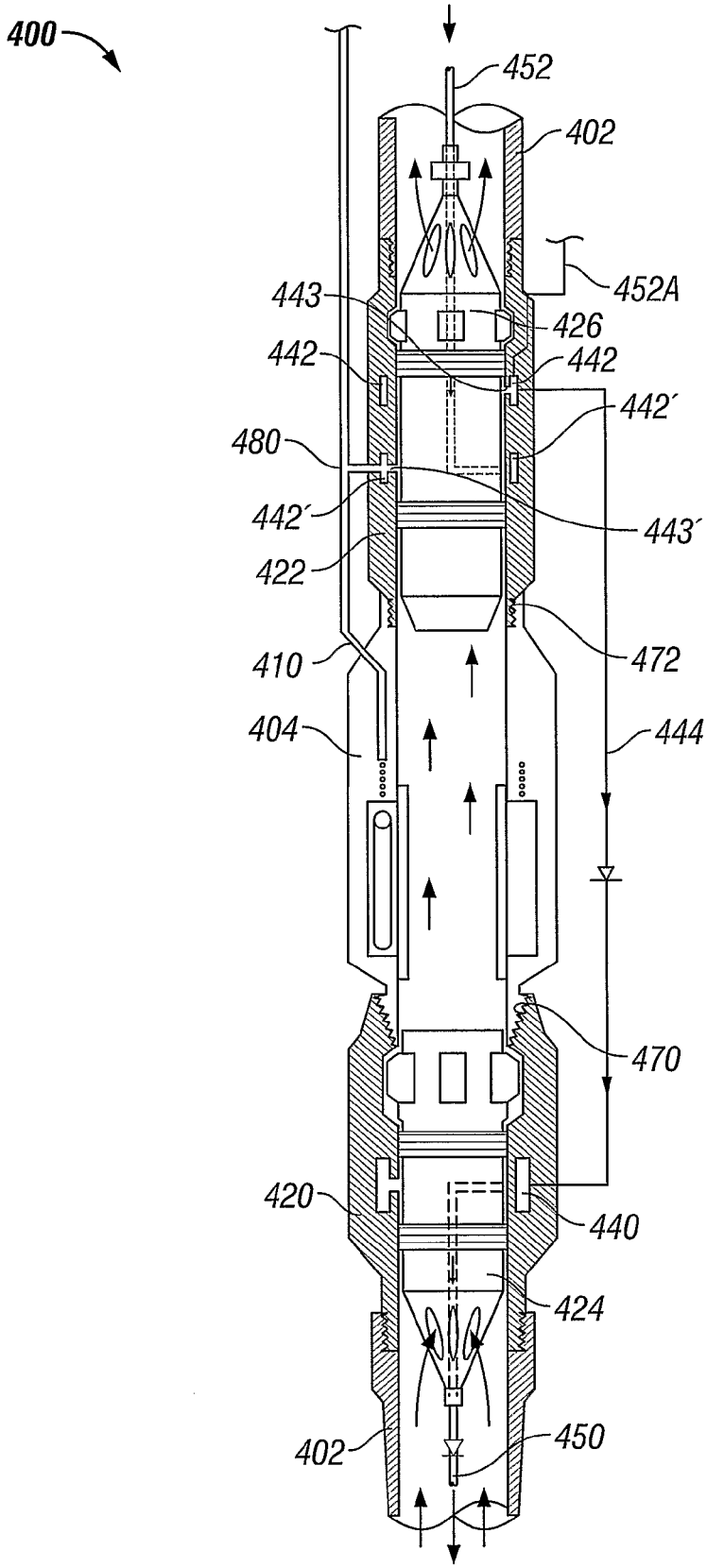
FIG. 4B is a schematic section-view drawing of the fluid bypass assembly of FIG. 4A wherein a fluid communication pathway to the redundant control hydraulic port is opened to enable redundant control of the well tool with the upper injection conduit.

FIGS. 4A-4B illustrate an alternative embodiment of a fluid bypass assembly 400. Although assembly 400 is illustrated as constructed from several threaded components, it can be a unitary arrangement as detailed in FIG. 1 without departing from the spirit of the invention. Fluid bypass assembly 400 in FIGS. 4A-4B includes a string of production tubing 402 connected to a well tool 404 through upper 422 and lower 420 anchor socket subs. Well tool 404, shown schematically as a surface controlled subsurface safety valve, is itself constructed as a sub with threaded connections 470, 472 on either end.

Hydraulic bypass pathway 444 connects first hydraulic port 442 in the upper anchor socket 422 to second hydraulic port 440 in the lower anchor socket 420. As the upper injection conduit 452 is in communication with the upper anchor socket 422 and the lower injection conduit 450 is in communication with lower anchor socket 420, the hydraulic bypass pathway 444 fluidicly connects the conduits (452, 450). So configured, a fluid can be injected from the surface station through upper injection conduit 452, the hydraulic bypass pathway 444, the lower injection conduit 450, and into the well while bypassing the well tool 404, shown as a surface controlled subsurface safety valve. The well tool 404 can be actuated from a surface location with hydraulic control line 410 as desired and fluid can be injected using bypass pathway 444 independent of the operation of well tool 404.

The upper (or first) injection conduit 452 can optionally be used as a redundant control for a well tool 404, shown as a subsurface safety valve, in the manner discussed above. The redundant control means illustrated in FIG. 4A includes a three-way manifold 480, which can be a three-way valve if so desired, connecting hydraulic control line 410 to redundant control hydraulic port 442' of upper anchor socket 422. Hydraulic control line 410 also is operably connected to well tool 404 and extends to a surface station.

Redundant control hydraulic port 442' can be any type of port although shown as a circumferential chamber in body of upper anchor socket 422. FIG. 4A illustrates the upper anchor socket 422 before communication between the redundant control hydraulic port 442' and the upper injection conduit 452 is enabled. Redundant control hydraulic port 442' is formed in upper anchor socket 422 but no connection to the bore of upper anchor socket 422 is created. Although formed below the first hydraulic port 442 in FIGS. 4A-4B, redundant control hydraulic port 442' can be formed above without departing from the spirit of the invention.

When redundant control of the well tool 404 with the upper injection conduit 452 is desired, communication between the upper injection conduit 452 and the redundant control hydraulic port 442' is enabled. Means for enabling communication include, but are not limited to, punching a hole in the wall of the upper anchor socket 422 into the circumferential redundant control hydraulic port 442' or punching a disc out of a preformed pathway in the upper anchor socket 422 to allow communication with the circumferential redundant control hydraulic port 442'. One non-limiting example of a downhole punch is described in U.S. Pat. No. 1,785,419 to Ross, herein incorporated by reference. A downhole punch, as is known to one of ordinary skill in the art, can be included as part of upper anchor seal assembly 426, but preferably is a separate tool. When using a separate downhole punch, the upper anchor seal assembly 426 is removed to allow disposition of downhole punch into upper anchor socket 422 to punch a hole or other void at the portion 446 of the bore adjacent the redundant control hydraulic port 442'.

Turning now to FIG. 4B, a downhole punch has been previously disposed into the upper anchor socket 422 to create a fluid communication pathway 443'. Fluid communication pathway 443' has been punched out by a downhole punch. So configured, the bore of the upper anchor socket 422 is in communication with the redundant control hydraulic port 442' through the fluid communication pathway 443' therebetween. A plurality of seals creates a zone between the bore of the upper anchor socket 422 and the outer surface of the upper anchor seal assembly 426. As the upper injection conduit 452 is in communication with this zone, a fluid can be injected therein. The fluid flows through fluid communication pathway 443' into redundant control hydraulic port 442', which in turn is in communication with the three-way manifold 480, and thus the hydraulic control line 410 and well tool 404. Upper injection conduit 452 can then be used as a redundant control to actuate the well tool 404. Optionally, three-way manifold can be a three-way valve (not shown) as described in reference to FIGS. 3A-3B, although a burst disc 190 is not required. Three-way valve can allow the section of hydraulic control line 410 extending above the connection to the redundant control hydraulic port 442', to be sealed such that any inability of said section of hydraulic control line 410 to retain pressure does not affect the actuation of the subsurface safety valve 404 by fluid supplied from the upper injection conduit 452. Although illustrated with a three-way valve, any means to block said section of hydraulic control line 410 can be utilized.

Numerous embodiments and alternatives thereof have been disclosed. While the above disclosure includes the best mode belief in carrying out the invention as contemplated by the inventors, not all possible alternatives have been disclosed. For that reason, the scope and limitation of the present invention is not to be restricted to the above disclosure, but is instead to be defined and construed by the appended claims.

What is claimed is:

1. An assembly to inject fluid from a surface station around a well tool located within a string of production tubing, the assembly comprising:

a lower anchor socket located in the string of production tubing below the well tool;

an upper anchor socket located in the string of production tubing above the well tool;

a lower injection anchor seal assembly engaged within said lower anchor socket;

an upper injection anchor seal assembly engaged within said upper anchor socket;

a first injection conduit extending from the surface station to said upper injection anchor seal assembly, said first injection conduit in communication with a first hydraulic port of said upper anchor socket;

a second injection conduit extending from said lower injection anchor seal assembly to a location below the well tool, said second injection conduit in communication with a second hydraulic port of said lower anchor socket;

a fluid pathway to bypass the well tool and allow hydraulic communication between said first hydraulic port and said second hydraulic port; and a hydraulic control line in communication with a surface location and the well tool, said hydraulic control line in further communication with at least one of the first hydraulic port of said upper anchor socket, the second hydraulic port of said lower anchor socket, and the fluid pathway.

2. The assembly of claim 1 wherein the hydraulic control line further comprises a three-way valve, the valve having a first position wherein the surface location and the well tool are in communication and communication with said at least one of the first hydraulic port of said upper anchor socket, the second hydraulic port of said lower anchor socket, and the fluid pathway is inhibited, and a second position wherein said at least one of the first hydraulic port of said upper anchor socket, the second hydraulic port of said lower anchor socket, and the fluid pathway is in communication with the well tool and communication with the surface location is inhibited.

3. The assembly of claim 2 wherein the hydraulic control line further comprises a burst disc between the three-way valve and said at least one of the first hydraulic port of said upper anchor socket, the second hydraulic port of said lower anchor socket, and the fluid pathway.

4. The assembly of claim 3 wherein the well tool is a subsurface safety valve.

5. A method to inject fluid from a surface station around a subsurface safety valve located within a string of production tubing using the assembly of claim 4 comprising:

installing the assembly into a well bore; and injecting a fluid from the surface station through the first injection conduit, the fluid pathway, and the second injection conduit into the location below the well tool at a pressure lower than a rupture pressure of the burst disc.

6. The method of claim 5 further comprising:

injecting the fluid through said at least one of the first hydraulic port of said upper anchor socket, the second hydraulic port of said lower anchor socket, and the fluid pathway at least at the rupture pressure to rupture the burst disc;

disposing the three-way valve to the second position; and actuating a closure member of the subsurface safety valve through the first injection conduit.

7. The method of claim 6 wherein the step of injecting the fluid at least at the rupture pressure disposes the three-way valve to the second position after the burst disc ruptures.

8. The assembly of claim 1 wherein the hydraulic control line extends through an annulus formed between the string of production tubing and a wellbore.

9. The assembly of claim 1 wherein the fluid pathway extends between the upper and lower anchor sockets through an annulus formed between the string of production tubing and a wellbore.

10. An assembly to inject fluid around a well tool located within a string of production tubing, the assembly comprising:

an anchor socket located in the string of production tubing below the well tool;

an injection anchor seal assembly engaged within said anchor socket;

an injection conduit extending from said injection anchor seal assembly to a location below the well tool, said injection conduit in hydraulic communication with a hydraulic port of said anchor socket;

a fluid pathway extending from a surface station through an annulus between the string of production tubing and a wellbore, the fluid pathway in communication with said hydraulic port; and a hydraulic control line in communication with a surface location and the well tool, said hydraulic control line in further communication with at least one of the hydraulic port of said anchor socket, the injection conduit, and the fluid pathways, wherein the well tool is a subsurface safety valve.

11. The assembly of claim 10 wherein the hydraulic control line further comprises a three-way valve, the valve having a first position wherein the surface location and the well tool are in communication and communication with said at least one of the hydraulic port of said anchor socket, the injection conduit, and the fluid pathway is inhibited, and a second position wherein said at least one of the hydraulic port of said anchor socket, the injection conduit, and the fluid pathway is in communication with the well tool and communication with the surface location is inhibited.

12. The assembly of claim 11 wherein the three-way valve actuates from the first position to the second position when a fluid is injected at an opening pressure through said at least one of the hydraulic port of said anchor socket, the injection conduit, and the fluid pathway.

13. The assembly of claim 11 wherein the hydraulic control line further comprises a burst disc between the three-way valve and said at least one of the hydraulic port of said anchor socket, the injection conduit, and the fluid pathway.

14. An assembly to inject fluid from a surface station around a well tool located within a string of production tubing, the assembly comprising:

a lower anchor socket located in the string of production tubing below the well tool;

an upper anchor socket located in the string of production tubing above the well tool;

a lower injection anchor seal assembly engaged within said lower anchor socket;

an upper injection anchor seal assembly engaged within said upper anchor socket;

a first injection conduit extending from the surface station to said upper injection anchor seal assembly, said first injection conduit in communication with a first hydraulic port of said upper anchor socket;

a second injection conduit extending from said lower injection anchor seal assembly to a location below the well tool, said second injection conduit in communication with a second hydraulic port of said lower anchor socket;

a fluid pathway to bypass the well tool and allow hydraulic communication between said first hydraulic port and said second hydraulic port; and a hydraulic control line extending between the well tool and at least one of the first hydraulic port of said upper anchor socket, the second hydraulic port of said lower anchor socket, and the fluid pathway.

15. The assembly of claim 14 further comprising a burst disc in the hydraulic control line.

16. An assembly to inject fluid from a surface station around a well tool located within a string of production tubing, the assembly comprising:

a lower anchor socket located in the string of production tubing below the well tool;

an upper anchor socket located in the string of production tubing above the well tool;

a lower injection anchor seal assembly engaged within said lower anchor socket;

an upper injection anchor seal assembly engaged within said upper anchor socket;

a first injection conduit extending from the surface station to said upper injection anchor seal assembly, said first injection conduit in communication with a first hydraulic port of said upper anchor socket;

a second injection conduit extending from said lower injection anchor seal assembly to a location below the well tool, said second injection conduit in communication with a second hydraulic port of said lower anchor socket;

a fluid pathway to bypass the well tool and allow hydraulic communication between said first hydraulic port and said second hydraulic port;

a hydraulic control line in communication with a surface location and the well tool, said hydraulic control line in further communication with a redundant control hydraulic port of said upper anchor socket; and means for enabling communication between the redundant control hydraulic port and the first injection conduit.

17. The assembly of claim 16 wherein the means for enabling communication between the redundant control hydraulic port and the first injection conduit comprises:

a downhole punch creating a fluid communication pathway in the upper anchor socket in communication with the redundant control hydraulic port and the first injection conduit.

18. The assembly of claim 16 wherein the hydraulic control line further comprises a three-way valve, the valve having a first position wherein the surface location and the well tool are in communication and communication with the redundant control hydraulic port is inhibited, and a second position wherein the redundant control hydraulic port is in communication with the well tool and communication with the surface location is inhibited.

19. A method to inject fluid from a surface station around a subsurface safety valve located within a string of production tubing comprising:

installing the string of production tubing into a wellbore, the string of production tubing including a lower anchor socket below the subsurface safety valve and an upper anchor socket above the subsurface safety valve;

installing a lower anchor seal assembly to the lower anchor socket, the lower anchor seal assembly including a lower injection conduit extending therebelow;

installing an upper anchor seal assembly to the upper anchor socket, the upper anchor seal assembly disposed upon a distal end of an upper injection conduit extending from a surface station;

installing a hydraulic control line extending from a surface location to a three-way valve, the three-way valve connecting the hydraulic control line, a hydraulically actuated closure member of the subsurface safety valve, and the upper injection conduit, the valve having a first position wherein the hydraulic control line and the hydraulically actuated closure member are in communication and communication with the upper injection conduit is inhibited, and a second position wherein the upper injection conduit is in communication with the hydraulically actuated closure member and communication with the hydraulic control line is inhibited; and communicating between the upper injection conduit and the lower injection conduit through a fluid pathway around the subsurface safety valve.

20. The method of claim 19 further comprising: injecting a fluid from the surface station through the upper injection conduit, the fluid displacing the three-way valve to the second position; and actuating the hydraulically actuated closure member from the surface station through the upper injection conduit.

21. A method to inject fluid from a surface station around a subsurface safety valve located within a string of production tubing comprising:

installing the string of production tubing into a wellbore, the string of production tubing including a lower anchor socket below the subsurface safety valve and an upper anchor socket above the subsurface safety valve;

installing a lower anchor seal assembly to the lower anchor socket, the lower anchor seal assembly including a lower injection conduit extending therebelow;

installing an upper anchor seal assembly to the upper anchor socket, the upper anchor seal assembly disposed upon a distal end of an upper injection conduit extending from a surface station;

installing a hydraulic control line extending from a surface location to a three-way manifold, the three-way manifold connecting the hydraulic control line, a hydraulically actuated closure member of the subsurface safety valve, and a redundant control hydraulic port of the upper anchor socket; and communicating between the upper injection conduit and the lower injection conduit through a fluid pathway around the subsurface safety valve.

22. The method of claim 21 further comprising:

forming a fluid communication pathway in the upper anchor socket with a downhole punch, the fluid communication pathway in communication with the redundant control hydraulic port; and communicating between the upper injection conduit and the hydraulically actuated closure member through the fluid communication pathway and the redundant control hydraulic port.

23. The method of claim 22 further comprising:

uninstalling the upper anchor seal assembly before forming the fluid communication pathway with the downhole punch; and reinstalling the upper anchor seal assembly thereafter.

24. The method of claim 22 further comprising:

blocking communication of the hydraulic control line between the surface location and the three-way manifold.

25. An assembly to inject fluid around a well tool located within a string of production tubing, the assembly comprising:

an anchor socket located in the string of production tubing below the well tool;

an injection anchor seal assembly engaged within said anchor socket;

an injection conduit extending from said injection anchor seal assembly to a location below the well tool, said injection conduit in hydraulic communication with a hydraulic port of said anchor socket;

a fluid pathway extending from a surface station through an annulus between the string of production tubing and a wellbore, the fluid pathway in communication with said hydraulic port; and a hydraulic control line in communication with a surface location and the well tool, said hydraulic control line in further communication with at least one of the hydraulic port of said anchor socket, the injection conduit, and the fluid pathway, wherein the injection anchor seal assembly comprises an internal bypass pathway configured to transmit fluid between the fluid pathway and the injection conduit through the injection anchor seal assembly.

* * * * *